US007520841B2

(12) United States Patent
Ho

(10) Patent No.: US 7,520,841 B2
(45) Date of Patent: Apr. 21, 2009

(54) FOLDABLE AQUATIC STEPPER

(76) Inventor: Diana Ho, No. 13, Tien Suei West 6th Street, Taichung 407 (TW)

( * ) Notice: Subject to any disclaimer, the term of this patent is extended or adjusted under 35 U.S.C. 154(b) by 74 days.

(21) Appl. No.: 11/805,804

(22) Filed: May 25, 2007

(65) Prior Publication Data

US 2008/0293549 A1 Nov. 27, 2008

(51) Int. Cl.
*A63B 22/04* (2006.01)
*A63B 20/008* (2006.01)

(52) U.S. Cl. ..... 482/53; 482/111

(58) Field of Classification Search ..... 482/51–54, 482/57, 79–80, 111; D21/690–691
See application file for complete search history.

(56) References Cited

U.S. PATENT DOCUMENTS 4,772,015 A * 9/1988 Carlson et al. ..... 482/92
5,060,935 A * 10/1991 Dunn et al. ..... 482/53
5,116,295 A * 5/1992 Dunn et al. ..... 482/53
5,328,423 A * 7/1994 Abboudi et al. ..... 482/53
5,354,253 A * 10/1994 Awbrey et al. ..... 482/111
5,399,134 A * 3/1995 Abboudi et al. ..... 482/52
5,647,826 A * 7/1997 Butler ..... 482/111
5,868,649 A * 2/1999 Erickson et al. ..... 482/58

* cited by examiner

*Primary Examiner*—Steve R Crow

(57) ABSTRACT

A foldable aquatic stepper includes: a foldable frame device, and a stepping device mounted on the frame device having a pair of paddling pedals reciprocatively and alternatively stepped upon for a smooth aquatic stepping exercise.

6 Claims, 5 Drawing Sheets

FOLDABLE AQUATIC STEPPER

BACKGROUND OF THE INVENTION

U.S. Pat. No. 5,868,649 disclosed an aquatic exerciser device which is to be used in a pool having an element engaged by the foot or hand of an individual, which element is linked to a piston-cylinder combination so that as the user engagement element is moved by the user, the piston rides in the cylinder, thereby performing aquatic exercise.

However, such a prior art has the following drawbacks:

1. The user should sit down on the seat (20) for treadling the pedals (36). It is not suitable for an upright aquatic exercise when the user stands up.
2. The production or assembly for making the piston-cylinder combination may be complex, thereby increasing production cost and maintenance problems.
3. It is not foldable for reducing its volume, being inconvenient for the handling and storage.

The present inventor has found the drawbacks of the prior art and invented the present foldable aquatic stepper.

SUMMARY OF THE INVENTION

The object of the present invention is to provide a foldable aquatic stepper including: a foldable frame device, and a stepping device mounted on the frame device having a pair of paddling stepping pedals reciprocatively and alternatively stepped upon for a smooth aquatic stepping exercise.

DETAILED DESCRIPTION

Figure 1:
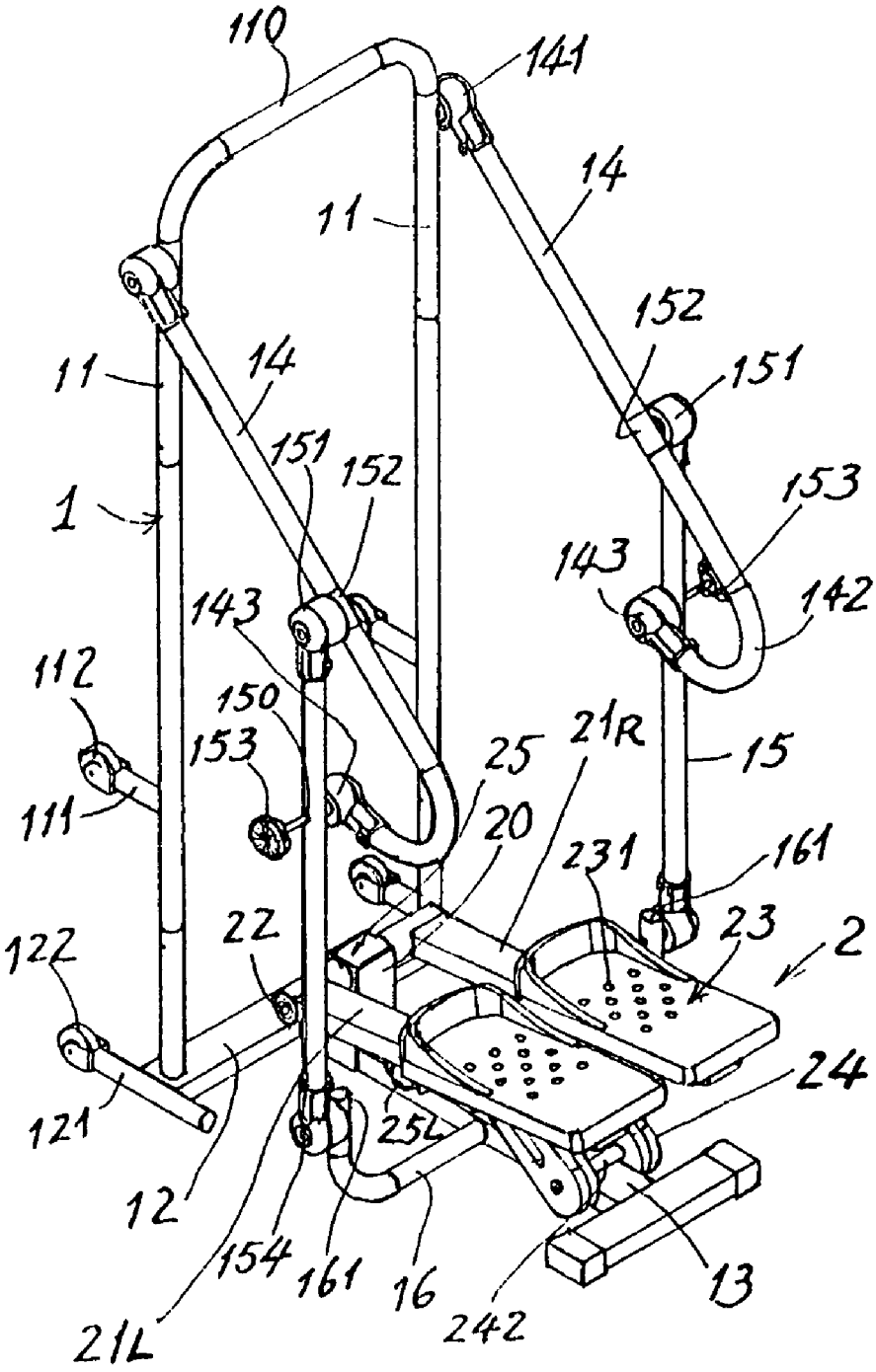
FIG. 1 is an illustration showing the aquatic stepper of the present invention.

As shown in the drawing figures, the present invention comprises: a foldable frame device 1; and a stepping means (or device) 2 foldably secured to the frame device 1, adapted to be immersed underwater such as in a pool, a big-size bath or a swim spa.

The foldable frame device 1 includes: a main frame 11 having a stand 12 formed on a bottom portion of the main frame 11, a base 13 pivotally secured to the stand 12 of the main frame 11 and having the stepping means 2 mounted on the base 13, a pair of hand rails 14 secured in parallel to the main frame 11 adapted to be held by a user's hands or arms, and a pair of supporting bars 15 respectively foldably secured to the pair of hand rails 14 and secured to the base 13 by a bottom bracket 16.

The main frame 11 is formed as a U shape having a horizontal bar 110 transversely formed on a top portion of the main frame 11 to serve as a handle for pulling or pushing the stepper of the present invention.

Figure 7:
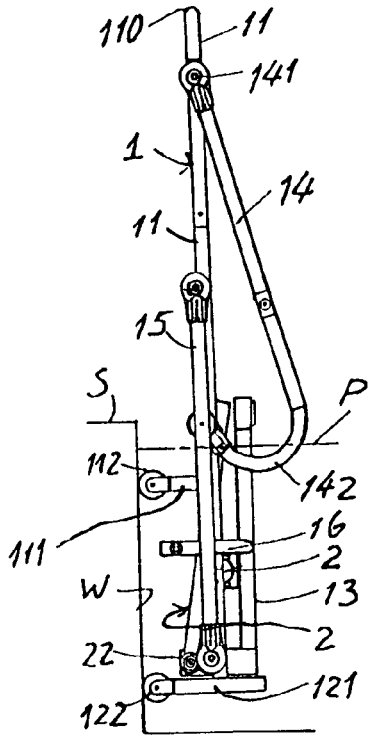
FIG. 7 shows the present invention when moved into a pool having wheels rolling on a side wall of the pool.

The main frame 11 includes a pair of arm members 111 each having an arm wheel 112 rotatably secured to each arm member 111, and the stand 12 has a pair of leg members 121 each having a leg wheel 122 rotatably secured to each leg member 121, thereby providing a plurality of wheels 112, 122 to be rolled on a floor surface S or a side wall W of a pool P as shown in FIG. 7.

Each hand rail 14 includes an upper connector 141 pivotally connected to an upper portion of the main frame 11, an elbow portion 142 formed on a lower portion of the hand rail 14, and a lower connector 143 formed on a lower end of the elbow portion 142 and connected to a supporting bar 15 by a coupling bolt 153 inserted through a bolt hole 150 formed through an upper portion of the supporting bar 15 (FIG. 1).

Each supporting bar 15 includes a sliding connector 151 formed on a top portion of the supporting bar 15 having a ring member 152 slidably held on the hand rail 14 and pivotally secured to the sliding connector 151, whereby upon a downward sliding movement of the ring member 152 on the hand rail 14 and upon a fastening of the ring member 152 on the hand rail 14 by a locking bolt provided within the sliding connector 151, the supporting bar 15 may be stably secured with the hand rail 14; and a bottom connector 154 formed on a lower end of the supporting bar 15 and pivotally connected with an upper end portion 161 of the bottom bracket 16.

Figure 6:
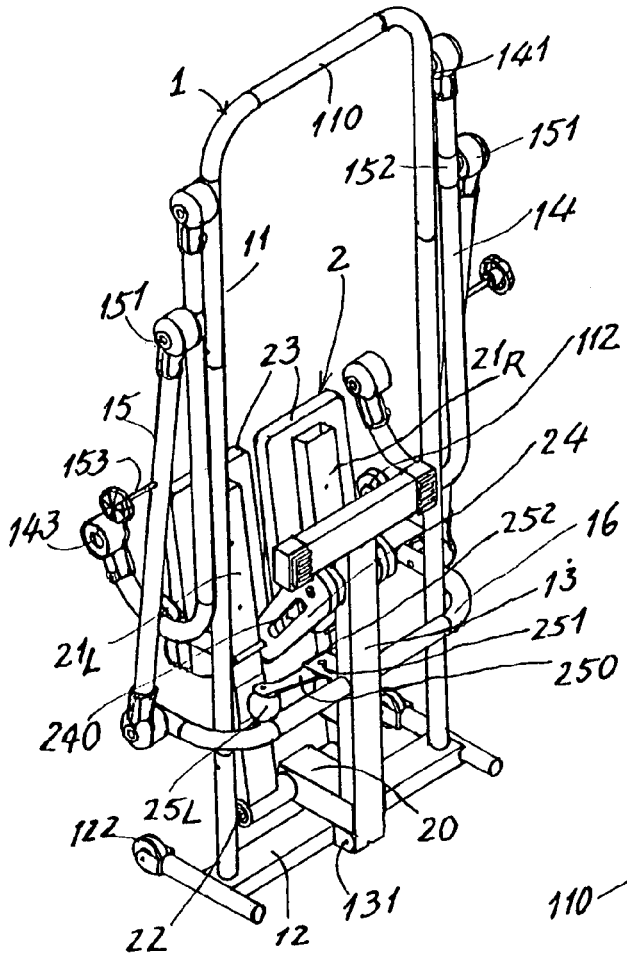
FIG. 6 shows a folded stepper in accordance with the present invention.

The base 13 is pivotally secured to the stand 12 of the main frame 11 by a pivot 131 so that the base 13 having the stepping means 2 formed thereon may be folded towards the main frame 11 to be a folded stepper as shown in FIG. 6.

During the folding operation, the coupling bolt 153 should be disconnected from the lower connector 143 of the hand rail 14 (FIG. 1 to FIG. 5); and the base 13 is vertically pivotally folded (from FIG. 5 to FIG. 6) to approximate the main frame 11, whereby the ring member 152 of the sliding connector 151 of the supporting bar 15 is slidably upwardly moved to fold the bars 15 towards the frame 11 as shown in FIG. 6, thereby forming a folded stepper for a convenient handling or storage.

The connectors 141, 151, 154 are each provided with a lockable pivot or bolt therein, thereby allowing a pivotal folding or unfolding operation for the stepper of the present invention and upon a proper adjustment for positioning the foldable parts or elements of the present invention, the pivot or bolt will then be stably locked in the corresponding connector.

Figure 2:
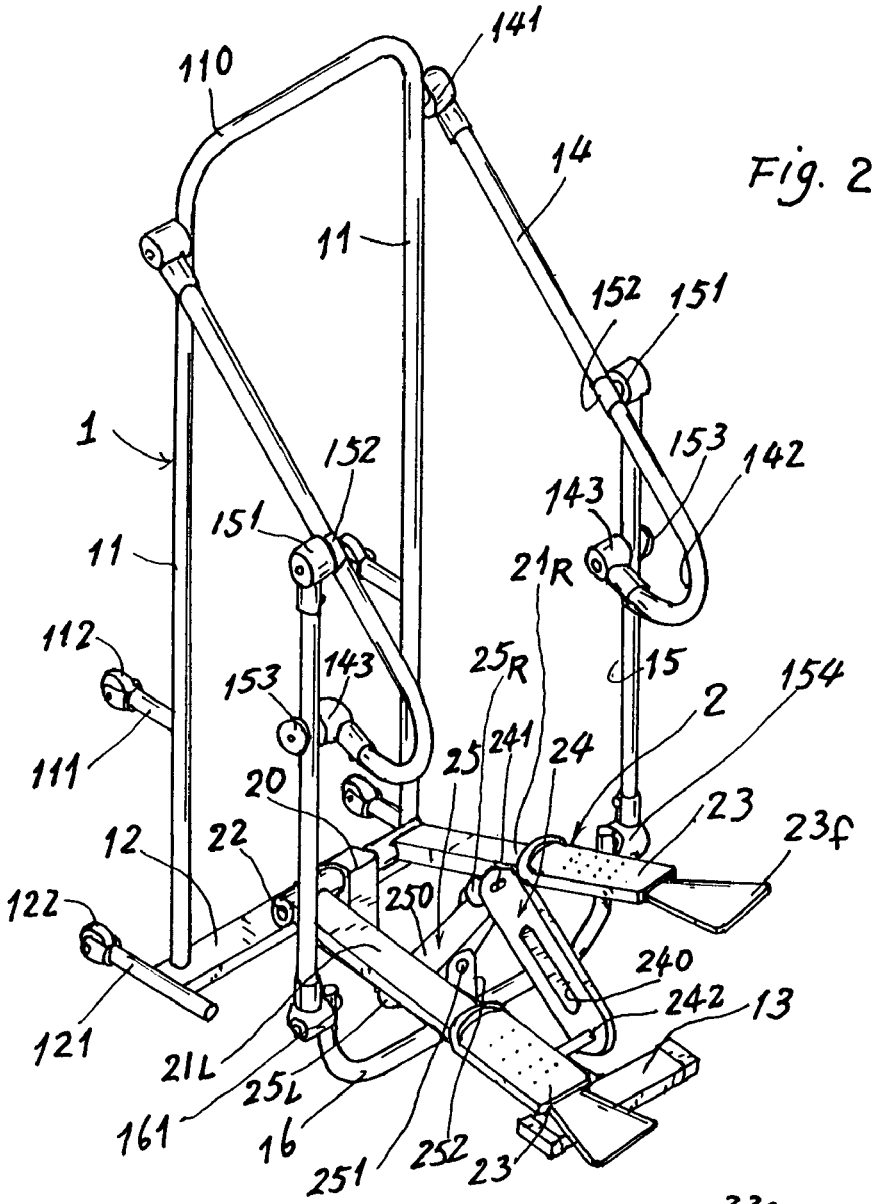
FIG. 2 shows the stepper of the present invention when reciprocatively stepped upon.
Figure 3:
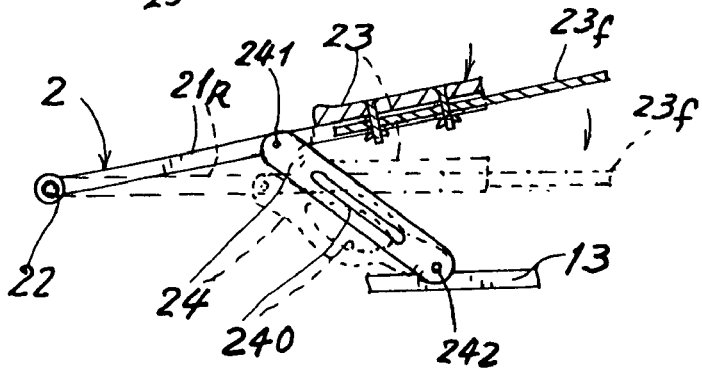
FIG. 3 is a partial illustration of the stepping device.
Figure 4:
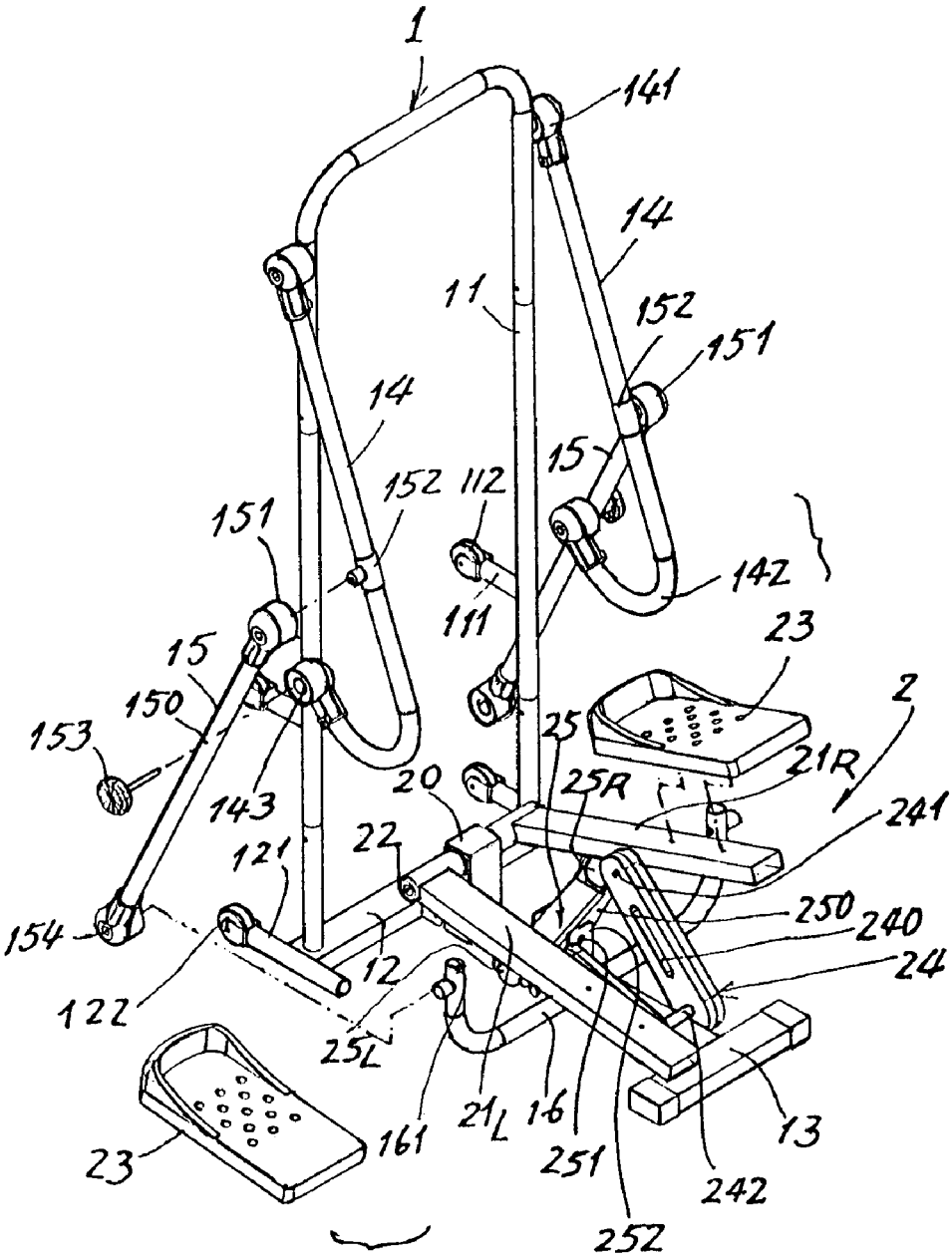
FIG. 4 is an exploded view showing the elements of the present invention.
Figure 5:
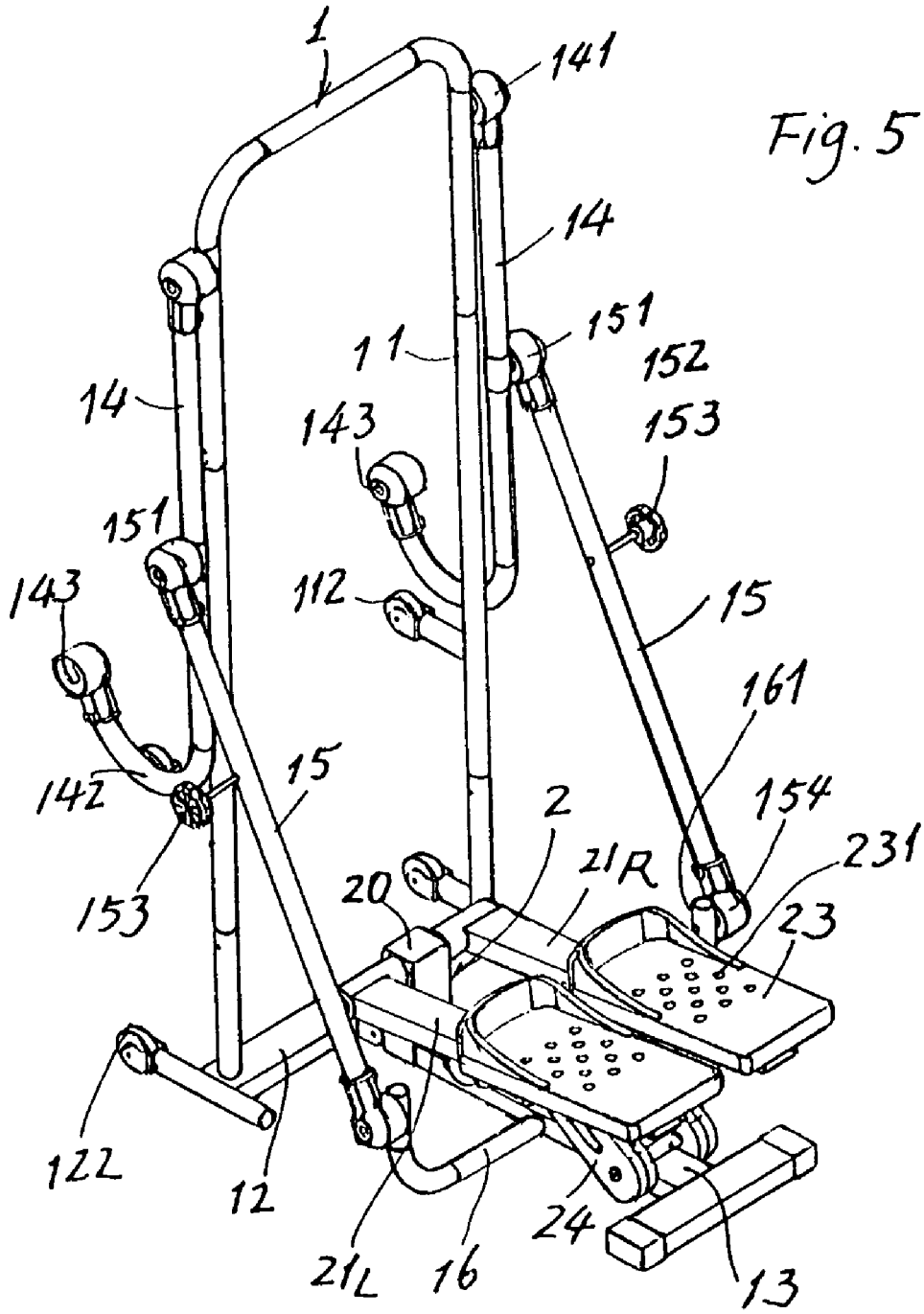
FIG. 5 shows a partially unfolded stepper of the present invention.

The stepping means 2 includes: a post 20 protruding on the base 13; a right stepping lever 21R pivoted about a right portion of an axle 20 secured to the post 20; a left stepping lever 21L pivoted about a left portion of the axle 20; a pair of paddling pedals 23 respectively detachably mounted on the right and left stepping levers 21R, 21L; a pair of tensioning members 24 each resiliently retained between each stepping lever 21R or 21L and the base 13; and a rocker means 25 alternatively supporting the right and left stepping levers 21R, 21L in a seesaw manner (FIGS. 2, 4).

The paddling pedal 23 may be formed as plural sizes having different areas so that the user may select his or her preferred size or area. Namely, when he or she is intended to adjust the resistance for respective or corresponding intensity training, he or she may increase the force to overcome the buoyancy acting upon each pedal 23 and then choose a pedal with larger size or area correspondingly. Therefore, the paddling pedal 23 is detachably mounted on the stepping lever 21R or 21L, adapted for an optional selection by the user for choosing or replacing a preferred pedal.

As shown in FIG. 2, an auxiliary fin member 23*f* is detachably secured on the stepping lever 21R or 21L together with the paddling pedal 23 for further increasing the force to resist the buoyancy acting upon the pedal 23 and the fin member 23*f*.

The paddling pedal 23 is formed with a plurality of perforations 231 therethrough, allowing water passing through the perforations 231 and helping a smooth treading on the pedal 23.

Each tensioning member 24 is generally formed as a strip of elastomer, such as made of: rubber, plastic, elastic composite, etc., having proper elasticity or resilience, to act like a "tension spring" as effected by the tensioning member 24; having an upper strip end secured to an upper bolt 241 fixed on the stepping lever 21R or 21L, a lower strip end secured to a lower bolt 242 secured to the base 13 of the frame device 1, and a slot 240 longitudinally formed in the strip, whereby upon treading or depression of the pedal 23 and lever 21R or 21L, the tensioning member 24 will be compressed to expand the slot 240 to restore a resilience for helping restoring of the tensioning member 24 and the pedal 23 when not depressed.

The rocker means 25 as shown in FIGS. 4 and 6 includes: a rocker arm 250 pivotally mounted on a stem 252 by a shaft 251 for alternatively supporting the right and left stepping levers 21R, 21L in a seesaw manner, a right ball 25R rotatably mounted on a right end portion of the rocker arm 250 for bearing the right stepping lever 21R, a left ball 25L rotatably mounted on a left end portion of the rocker arm 250 for bearing the left stepping lever 21L, with the stem 252 protruding from the base 13 and positioned between the post 20 of the stepping means 2 and the tensioning members 24.

When unfolding the stepper of the present invention in a pool, a downward treading or depression of a left pedal 23 and a right stepping lever 21R to overcome the buoyancy of water under the pedal and lever by a user's right foot, the rocker arm 250 of the rocker means 25 will bias the left stepping lever 21L and the left pedal upwardly in a seesaw manner to allow the left foot to reciprocatively move upwardly.

Alternatively and reciprocatively, upon the downward depression of the left pedal and left stepping lever 21L, the rocker means 25 will seesawly bias the right stepping lever 21R and right pedal upwardly in a seesaw manner. By the way, a stepping exercise may be done by the user's feet.

The present invention is superior to the prior art with the following advantages:

1. The pedals 23 and fin members 23*f* are optionally replaceable to be ergonomically stepped by the user.
2. The balls 25R, 25L rotatably secured on the rocker means 25 play a role of bearing for smoothly urging the right and left stepping levers 21R, 21L for a smooth stepping operation since the balls 25R, 25L serve as a bearing as disposed around by an in-situ "lubricant", namely, the water in the pool, thereby providing a smooth stepping operation by the aid of such an in-situ water "lubricant", and thereby preventing noise pollution.
3. The tension members 24 are made of elastomer materials, which are simple in construction and corrosion resistant especially when immersed in the water for a longer duration or service life.
4. The stepper may be folded for a convenient handling or storage, which will then be unfolded and assembled underwater for a comfortable aquatic stepping exercise.
5. It can be easily moved, unfolded or folded by an individual or a single user for freely enjoying a stepping exercise at anytime.

The present invention may be modified without departing from the spirit and scope of the present invention.

I claim:

1. A foldable aquatic stepper comprising:

a foldable frame device including: a main frame having a stand formed on a bottom portion of the main frame, a base pivotally secured to the stand of the main frame and having the stepping means mounted on the base, a pair of hand rails secured in parallel to the main frame adapted to be held by a user's hands or arms, and a pair of supporting bars respectively foldably secured to the pair of hand rails and secured to the base by a bottom bracket; each said supporting bar including a sliding connector formed on a top portion of the supporting bar having a ring member slidably held on the hand rail and pivotally secured to the sliding connector, whereby upon a downward sliding movement of the ring member on the hand rail and upon a fastening of the ring member on the hand rail by a locking bolt within the sliding connector, the supporting bar will be stably secured with the hand rail; and a bottom connector formed on a lower end of the supporting bar to be pivotally connected with an upper end portion of the bottom bracket; and a stepping means foldably secured to said frame device and including: a post protruding on the base; a right stepping lever pivoted about a right portion of an axle secured to the post; a left stepping lever pivoted about a left portion of said axle; a pair of paddling pedals respectively detachably mounted on the right and left stepping levers; a pair of tensioning members each resiliently retained between each said stepping lever and the base; and a rocker means alternatively supporting the right and left stepping levers; and said stepping means operatively stepped upon reciprocatively or alternatively against water buoyancy, when immersed in water, for an aquatic stepping exercise by a user's feet.

2. A stepper according to claim 1, wherein said paddling pedal is formed with a plurality of sizes having different areas so that the user may select his or her preferred size or area.

3. A stepper according to claim 1, wherein each said paddling pedal further includes an auxiliary fin member detachably secured on the stepping lever together with the paddling pedal for further increasing a force to resist the buoyancy acting upon the pedal and the fin member.

4. A stepper according to claim 1, wherein said paddling pedal is formed with a plurality of perforations therethrough for passing water through the perforations.

5. A stepper according to claim 1, wherein said tensioning member is generally formed as a strip of elastomer, having elasticity or resilience; having an upper strip end secured to an upper bolt fixed on the stepping lever, a lower strip end secured to a lower bolt secured to the base of the frame device, and a slot longitudinally formed in the strip, whereby upon treading or depression of the pedal and the stepping lever, the tensioning member will be compressed to expand the slot to restore a resilience for helping restoring of the tensioning member and the pedal when not depressed.

6. A stepper according to claim 1, wherein said rocker means includes: a rocker arm pivotally mounted on a stem by a shaft for alternatively supporting the right and left stepping levers in a seesaw manner, a right ball rotatably mounted on a right end portion of the rocker arm for bearing the right stepping lever, a left ball rotatably mounted on a left end portion of the rocker arm for bearing the left stepping lever, with the stem protruding from the base and positioned between the post of the stepping means and the tensioning members.

* * * * *